US007102963B2

(12) United States Patent
Matoge et al.

(10) Patent No.: US 7,102,963 B2
(45) Date of Patent: Sep. 5, 2006

(54) RADIO-WAVE CLOCK

(75) Inventors: Akihiro Matoge, Chiba (JP); Yoshifumi Maehara, Chiba (JP)

(73) Assignee: Seiko Instruments Inc., (JP)

( * ) Notice: Subject to any disclaimer, the term of this patent is extended or adjusted under 35 U.S.C. 154(b) by 0 days.

(21) Appl. No.: 11/326,214

(22) Filed: Jan. 5, 2006

(65) Prior Publication Data

US 2006/0153009 A1 Jul. 13, 2006

(30) Foreign Application Priority Data

Jan. 7, 2005 (JP) ..... 2005-002708

(51) Int. Cl.
*G04C 11/02* (2006.01)
*G04B 37/00* (2006.01)

(52) U.S. Cl. ..... 368/47; 368/88

(58) Field of Classification Search ..... 368/47, 368/88, 223, 228, 232
See application file for complete search history.

(56) References Cited

U.S. PATENT DOCUMENTS 5,737,699 A * 4/1998 Farrar et al. ..... 455/344
2004/0042344 A1* 3/2004 Motokawa et al. ..... 368/47
2004/0233789 A1* 11/2004 Oguchi et al. ..... 368/47
2005/0180266 A1* 8/2005 Hanai ..... 368/47
2005/0195689 A1* 9/2005 Oguchi ..... 368/47

* cited by examiner

*Primary Examiner*—Vit W. Miska
(74) *Attorney, Agent, or Firm*—Adams & Wilks

(57) ABSTRACT

To provide a radio-wave watch, which can have an excellent appearance and can minimize the drop of the sensitivity of receiving radio waves, while suppressing the size enlargement and the cost for the contour. A radio-wave watch comprises a metallic dial having an opening, and a receiving antenna for receiving the standard radio waves containing the time data. The receiving antenna is arranged on the back of the opening of the dial and in a case at a position to confront the opening. The receiving antenna is arranged in the case at a spacing from the dial. Time lapse indicating means substantially formed of a non-metal is arranged in the case between the dial and the receiving antenna for indicating the time lapse within the range of the opening.

5 Claims, 6 Drawing Sheets

FIG. 1A
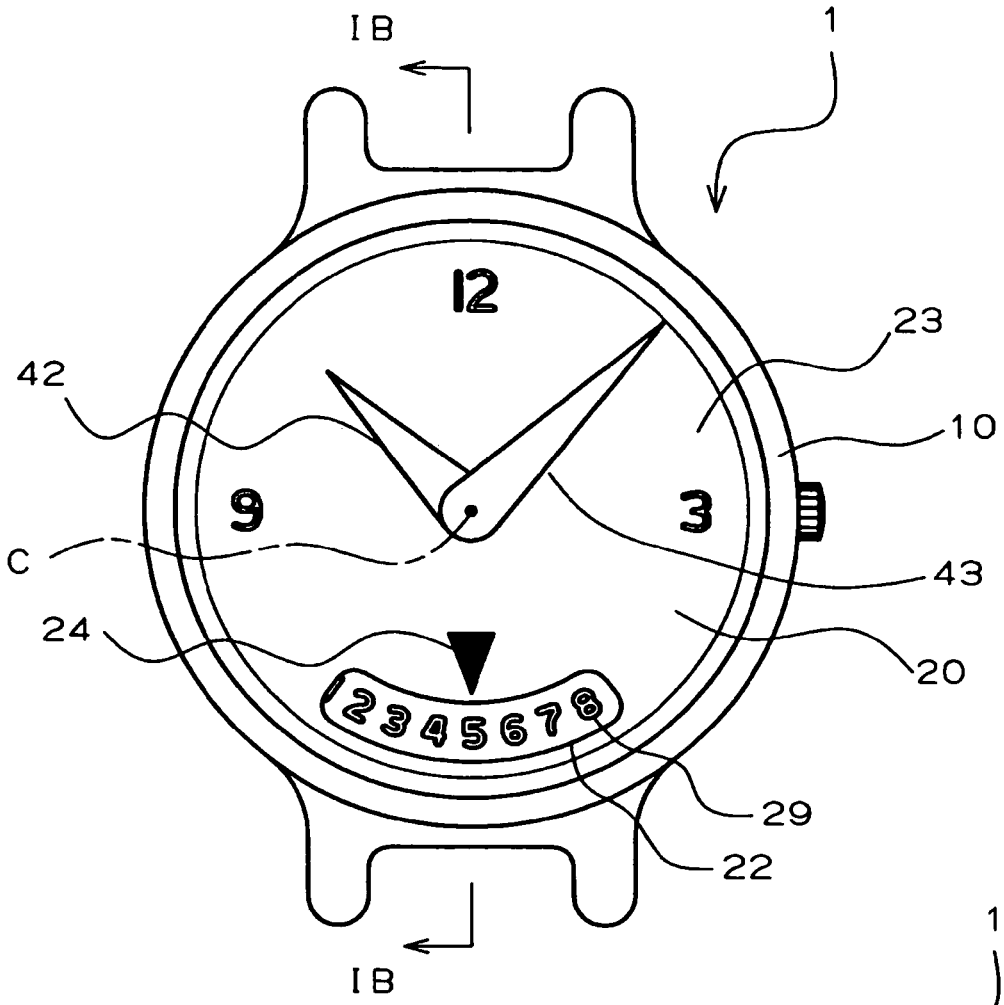
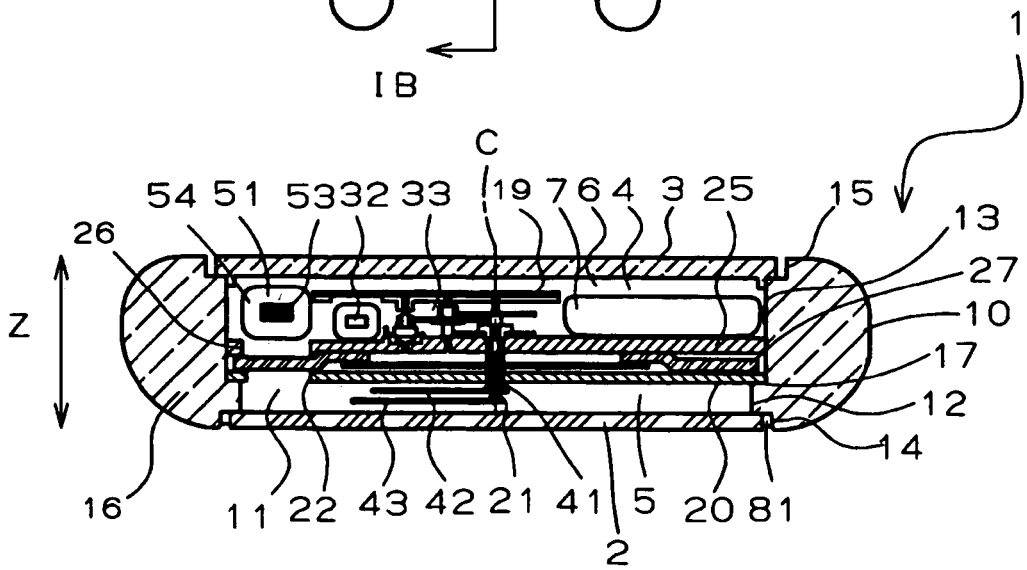
FIG. 1B

FIG. 2A
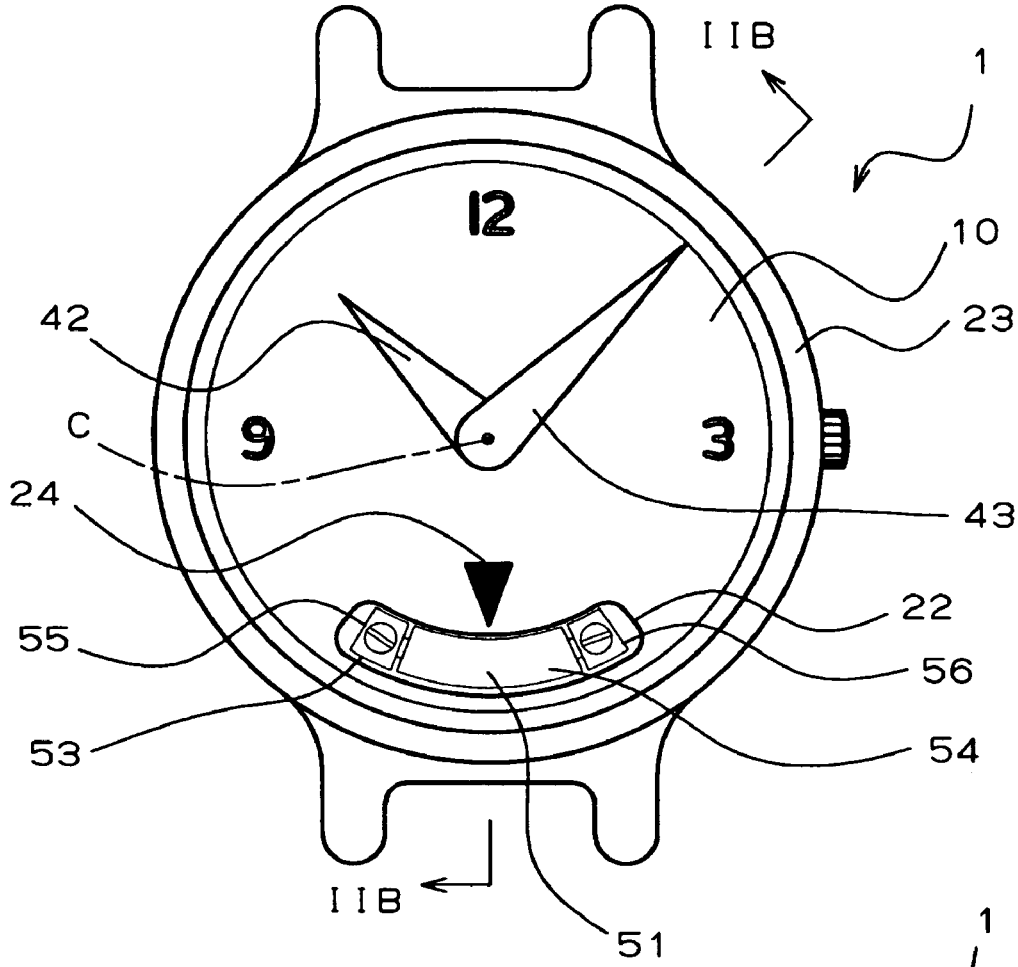
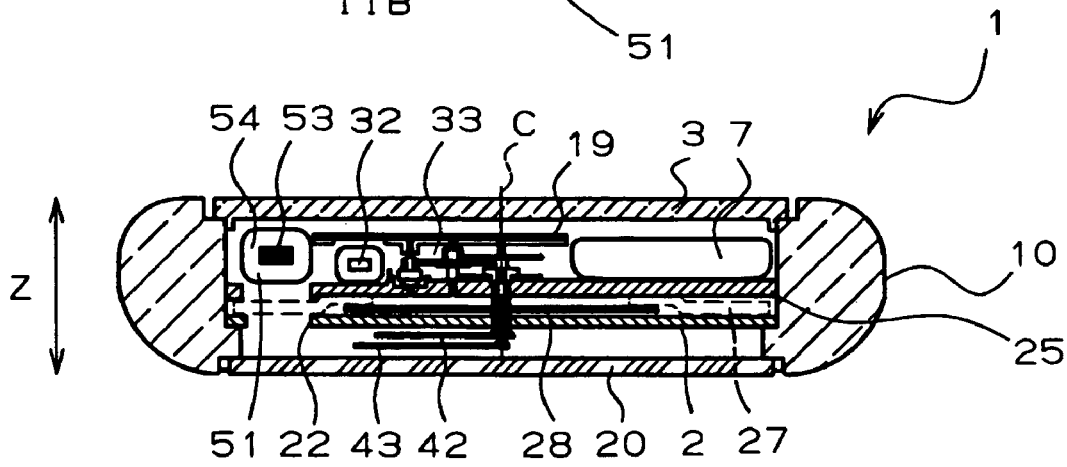
FIG. 2B

FIG. 3A
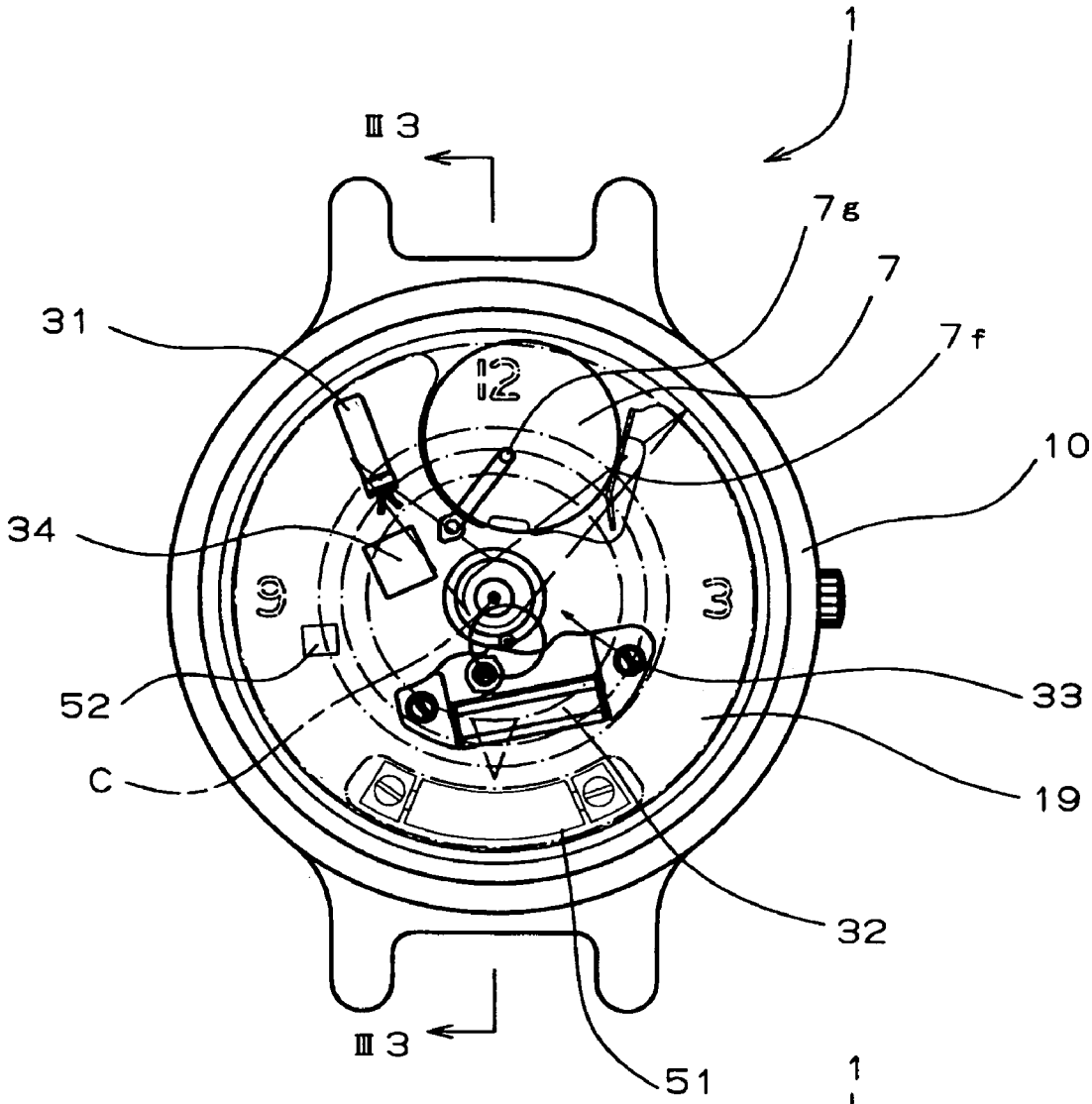
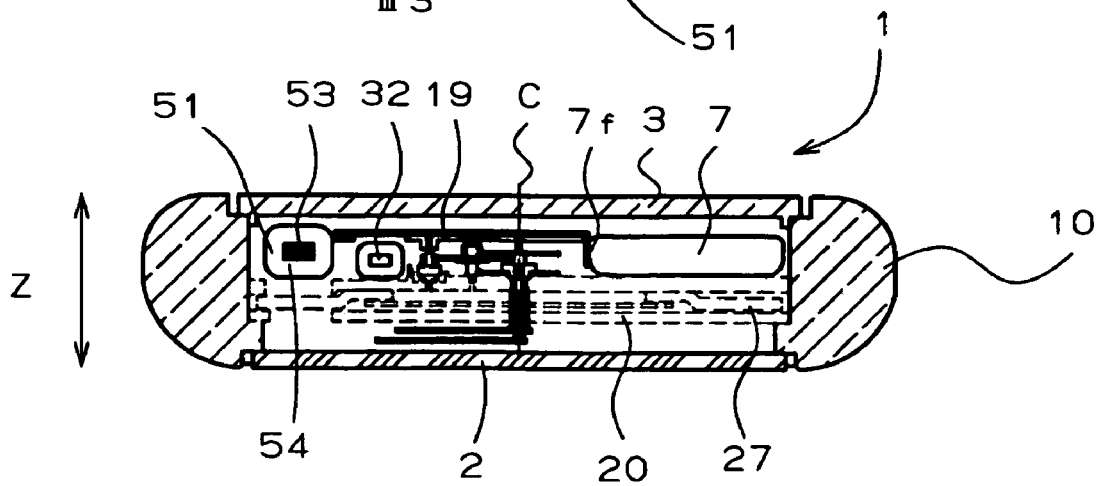
FIG. 3B

FIG. 4A
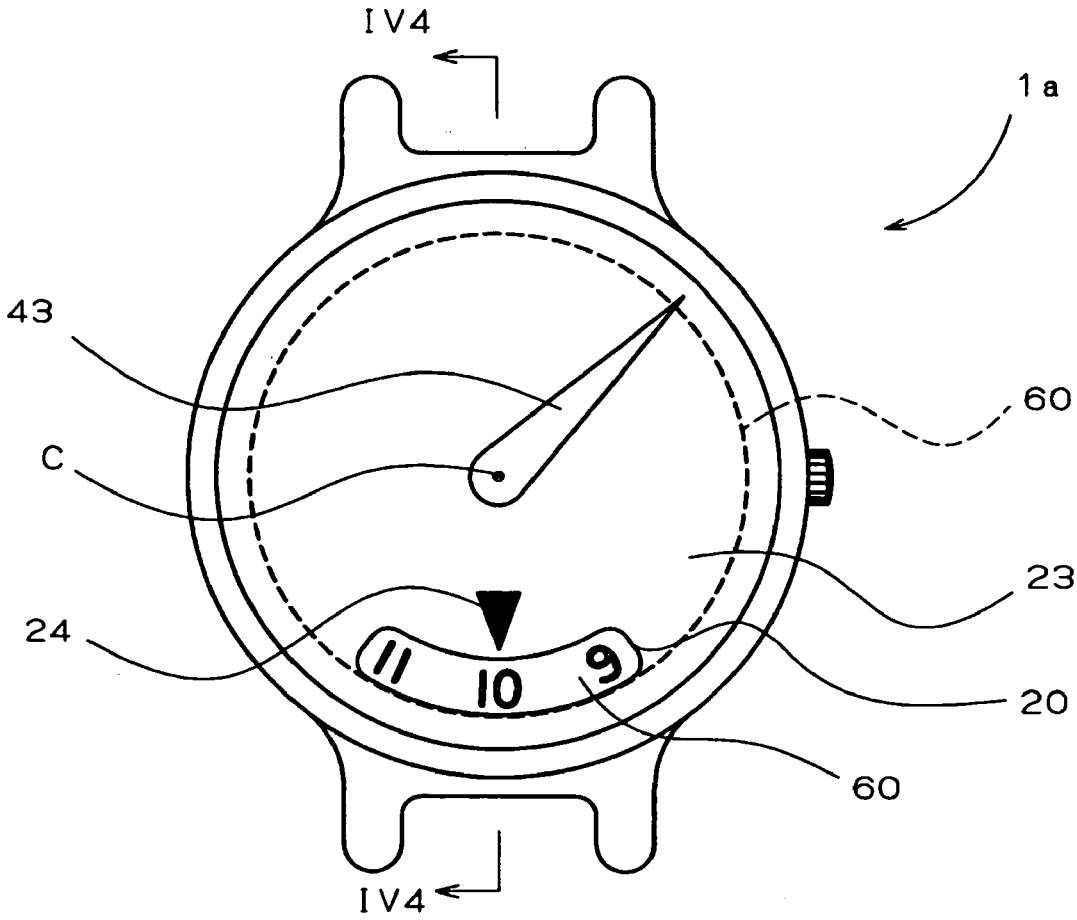
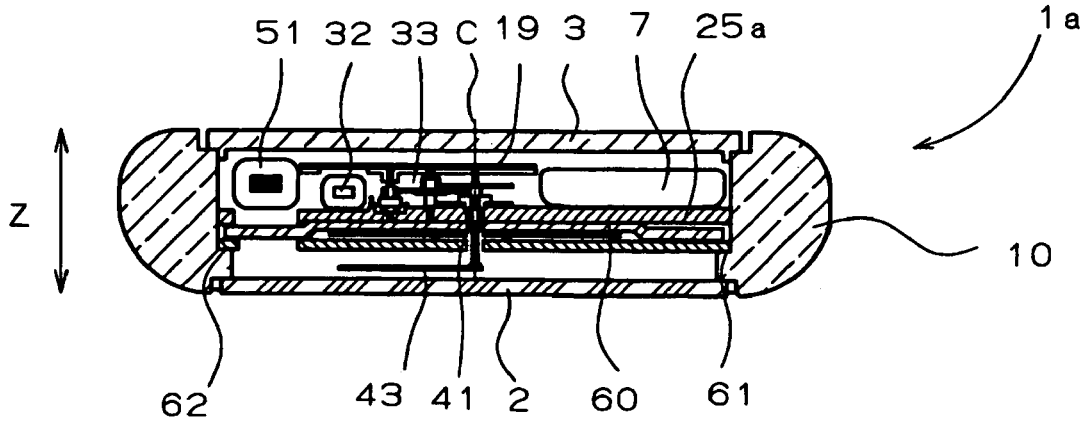
FIG. 4B

FIG. 5A
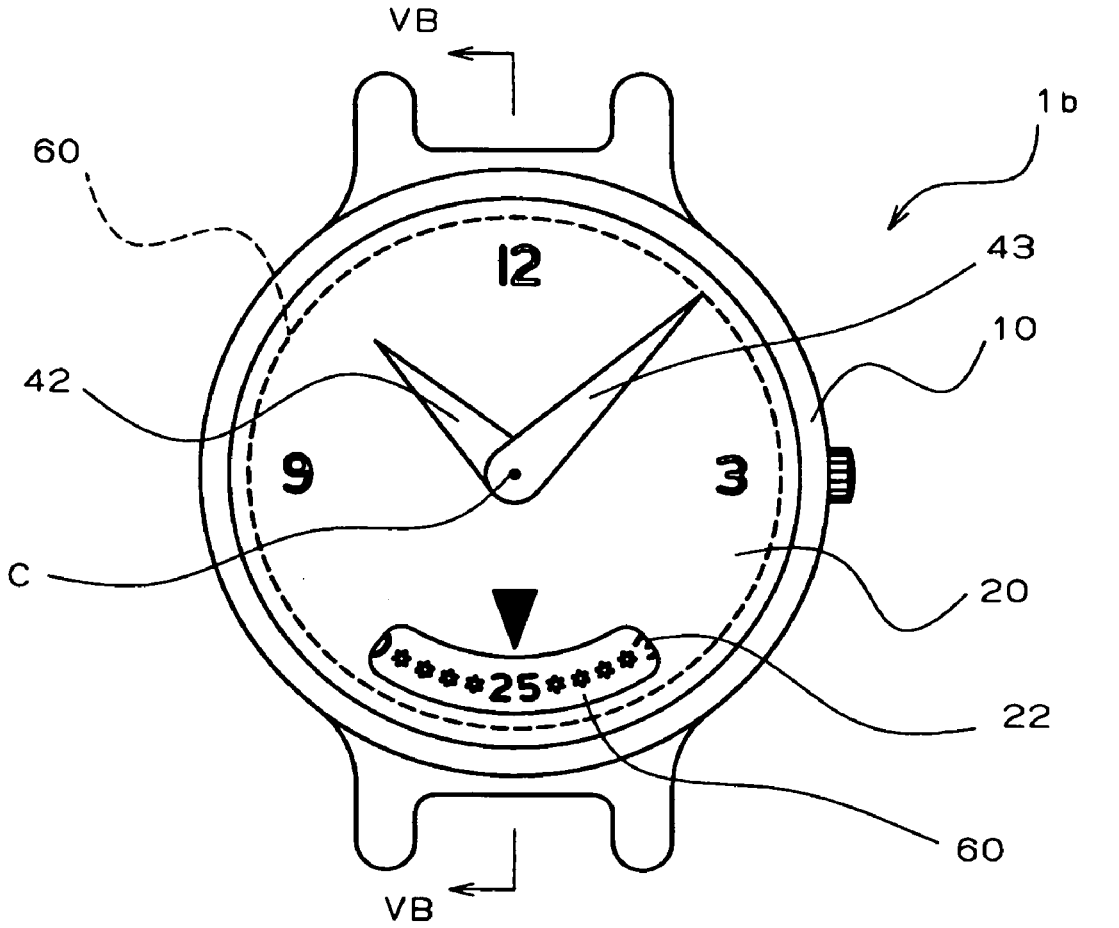
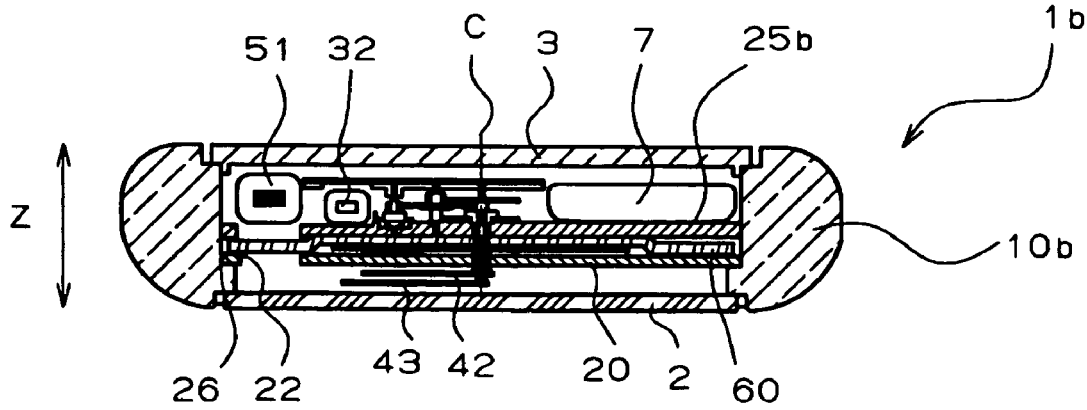
FIG. 5B

FIG. 6A
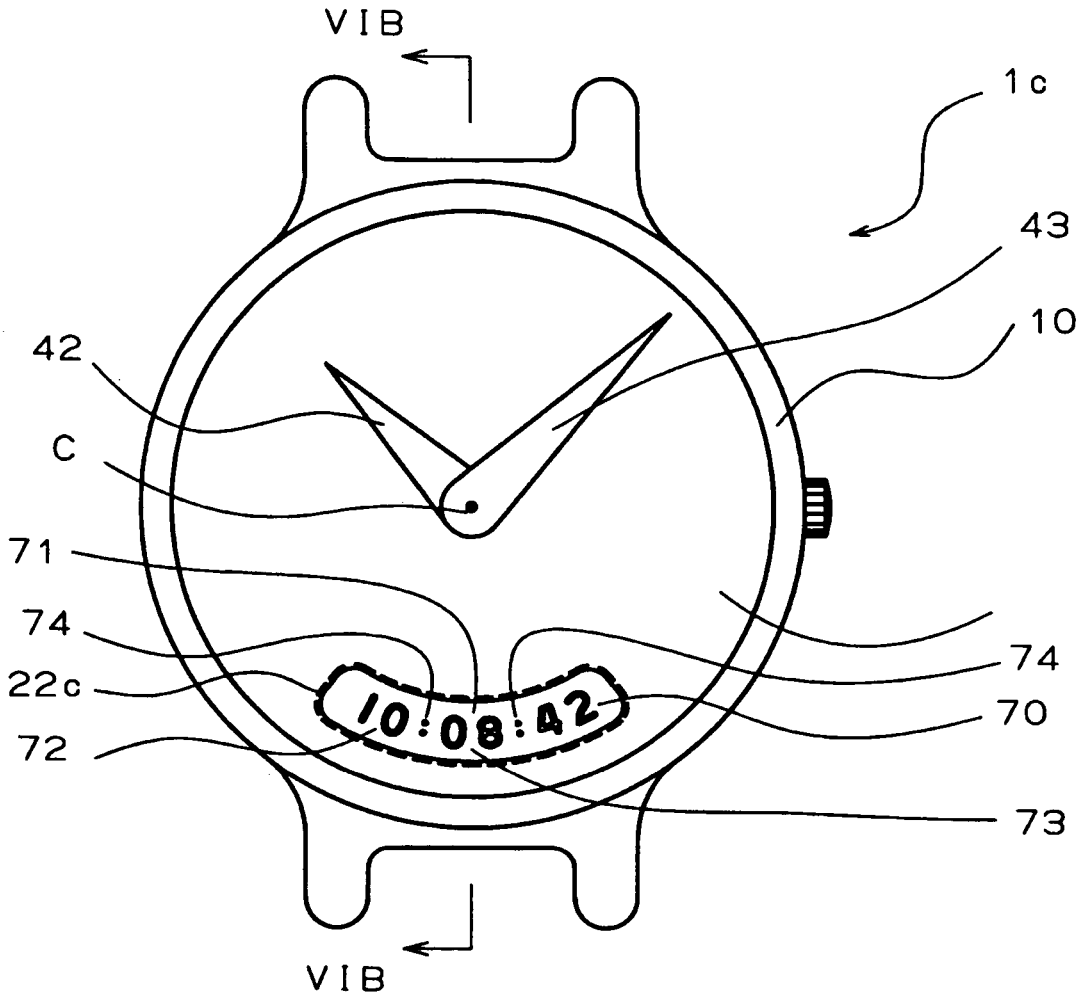
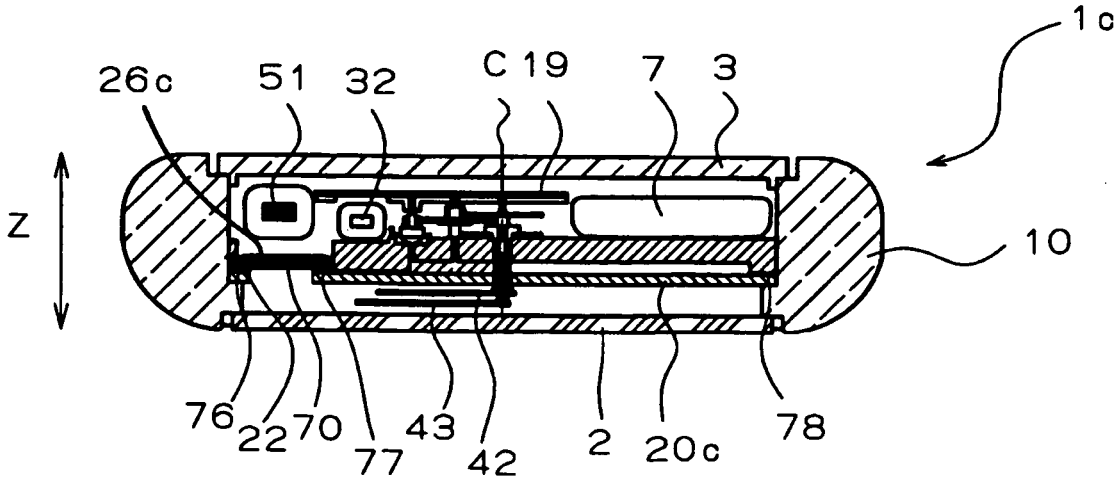
FIG. 6B

RADIO-WAVE CLOCK

BACKGROUND OF THE INVENTION

1. Field of the Invention

The present invention relates to a radio-wave watch and, more particularly, to a radio-wave watch suited for taking the mode of a wrist watch.

2. Description of the Prior Art

An antenna for receiving the standard radio waves is indispensable for the radio-wave watch, which adjusts its indication time to time data by receiving the standard radio waves containing the time data.

With a view to receiving the standard radio waves in high sensitivity by that antenna, it has been proposed (in JP-A-8-307141) to arrange a loop-shaped antenna in the outer circumference of the watch case.

In the radio-wave watch proposed in JP-A-8-307141, however, the contour or size may become so large as to provide a contour, exceeding a desired extent as the radio-wave watch to be worn oh the wrist.

On the other hand, it has also been proposed (in JP-A-2002-107463) to house the antenna in the case. In JP-A-2002-107463, however, the dial is formed of a resin so as to hold the receiving sensitivity of the antenna housed in the case.

In case, however, the dial made of a resin is used, as proposed in JP-A-2002-107463, a formatively complicated working on the surface is required for enhancing the appearance. This requirement makes it unavoidable to raise the cost and to elongate the fabrication process and accordingly the leadtime.

The present invention has been conceived in view of the aforementioned points and contemplates to provide a radio-wave watch, which can have an excellent appearance and can minimize the drop of the sensitivity of receiving the radio waves, while suppressing the size enlargement and the cost for the contour.

SUMMARY OF THE INVENTION

In order to achieve the aforementioned object, a radio-wave watch according to the invention comprises: a metallic dial having an opening; and a receiving antenna for receiving the standard radio waves containing the time data, the receiving antenna being arranged on the back of the opening of the dial and in a case at a position to confront the opening.

The radio-wave watch of the invention has its dial made of a metal so that it is easily realized with an excellent appearance at a low cost. Moreover, the radio-wave watch of the invention has its receiving antenna housed in the case so that its contour can be prevented from becoming large. Especially, the radio-wave watch of the invention has its dial formed to have the opening so that the radio waves can go into the case through the opening of the dial even when the dial is made of a metal. In the radio-wave watch of the invention, moreover, the receiving antenna is arranged on the back of the opening of the dial and at the position to confront the opening substantially. Therefore, the radio waves having entered the inside of the case through the opening can be reliably received by the receiving antenna so that the drop of the receiving sensitivity of the standard radio waves can be minimized although the dial is made of a metal.

In this specification, the phrase of "the receiving antenna is arranged on the back of the opening of the dial and at the position to confront the opening substantially" typically means that the entire receiving antenna "is arranged on the back of the opening of the dial and at the position to confront the opening within the range of the opening". As the case may be, however, a portion of the receiving antenna may not be at the position to confront the opening. Specifically, the opening of the metallic dial typically has an extension to confine the entirety of the receiving antenna at the confronting position within the opening. As the case may be, however, the receiving antenna may be partially outside of the extension range of the opening.

The receiving antenna may be of any type, so long as it can receive the standard radio waves, but typically takes the mode, in which a coil is wound on a magnetic core.

The opening typically has a flat shape similar to that of the receiving antenna but may have a flat shape different from that of the receiving antenna. In case the receiving antenna is in the mode having the coil wound on the magnetic core, the opening typically contains the receiving antenna within its extension range. In place of this mode, the intermediate portion of the receiving antenna, in which the coil is wound, may be partially located outside the extension range of the opening, so long as the protrusions of the magnetic core of the receiving antenna from the two ends of the coil are within the extension of the opening. For example, the opening may be larger at its portions to confront the two end portions of the receiving antenna and may be narrow and slender at its intermediate portion. Moreover, the opening is typically made of a continuous one but may be composed of two or more portions spaced at a short distance from each other as the case may be.

As the dial, the "metal" is usually an alloy but may be a single metal. Moreover, the "metal" is a conductive and easily workable material having an excellent appearance. If, however, the material practically exhibits the metallic conductivity so that it has the excellent appearance and is easily worked, it may be exemplified by the material which is not generally called as the metal.

In the radio-wave watch of the invention, the receiving antenna may be so exposed from the opening as can be directly viewed. According to the radio-wave watch of the invention, the receiving antenna is typically arranged in the case at a spacing from the dial on the back of the opening of the dial and at the position to substantially confront the opening, and the radio-wave watch further comprises time lapse indicating means substantially made of a non-metallic material and arranged in the case between the dial and the receiving antenna for indicating the time lapse within the range of the opening.

In this radio-wave watch, "the time lapse indicating means arranged in the case between the dial and the receiving antenna indicates the lapse of time within the range of the opening", so that the opening of the dial can be used to indicate the lapse of time while retaining the excellent appearance owing to the metallic dial. In the radio-wave watch of the invention, moreover, "the time lapse indicating means arranged in the case between the dial and the receiving antenna is substantially made of a non-metal" so that the possibility of lowering the reception sensitivity of the radio waves through the opening of the dial can be minimized by the time lapse indicating means.

Here, as to the time lapse indicating means, the phrase "substantially made of a non-metal" means that the major material is such a non-metal as not to obstruct the transmission of the standard radio waves practically. A portion of the time lapse indicating means may contain a metallic material so long as the metal does not obstruct the transmission of the standard radio waves practically.

In the radio-wave watch of the invention, the time lapse indicating means may include time information indicating means for indicating at least one of the day, date, hour, minute and second typically, although the drawings, the pictures or the patterns to be displayed through the opening may change with time so long as they indicate the lapse of time.

Typically, in this case, the receiving antenna extends in an arcuate shape near the inner circumference of the case, and the time information indicating means is made of a rotating member.

The rotating member composing the time information indicating means may typically be a circular or annular day indicator, date indicator, hour indicator or minute indicator. The hour indicator may be an ordinary one for making one rotation for 12 hours or a 24-hour indicator for making one rotation for 24 hours.

Here, the time lapse indicating means may be made of a liquid-crystal panel. In this case, the liquid-crystal panel is preferred to have the minimum ratio of the conductive portion obstructing the transmission of the radio waves.

BRIEF DESCRIPTION OF THE SEVERAL VIEWS OF THE DRAWINGS

A preferred form of the present invention is illustrated in the accompanying drawings in which:

FIG. 1 show radio-wave watches of a preferred first embodiment of the invention, and presents an explanatory top plan view at FIG. 1A and an explanatory section FIG. 1B taken along line IB—IB of FIG. 1A (although excepting the direction of hands);

FIG. 2 show the radio-wave watches of FIG. 1 while omitting the date indicator, and presents an explanatory top plan view at FIG. 2A and an explanatory section FIG. 2B taken along line IIB—IIB of FIG. 2A (although excepting the direction of hands);

FIG. 3 show the radio-wave watches of FIG. 1 while omitting the dial, the date indicator and the main plate, and presents an explanatory top plan view at FIG. 3A and an explanatory section FIG. 3B taken along line IIIB—IIIB of FIG. 3A (although excepting the direction of hands);

FIG. 4 show an radio-wave watches of a preferred second embodiment of the invention, and presents an explanatory top plan view similar to FIG. 4A of FIG. 1 and an explanatory section FIG. 4B taken along line IVB—IVB of FIG. 4A (although excepting the direction of hands);

FIG. 5 show an radio-wave watches of a preferred third embodiment of the invention, and presents an explanatory top plan view similar to FIG. 5A of FIG. 1 and an explanatory section FIG. 5B taken along line VB—VB of FIG. 5A (although excepting the direction of hands); and FIG. 6 show an radio-wave watches of a preferred fourth embodiment of the invention, and presents an explanatory top plan view similar to FIG. 6A of FIG. 1 and an explanatory section FIG. 6B taken along line VIB—VIB of FIG. 6A (although excepting the direction of hands).

DETAILED DESCRIPTION OF THE PREFERRED EMBODIMENTS

The present invention will be described in connection with preferred modes of embodiment with reference to the accompanying drawings.

FIG. 1 to FIG. 3 show a radio-wave watch 1 of a first preferred embodiment according to the invention. The radio-wave watch 1 is provided, in the mode of a wrist watch, with a generally annular case 10, which has an opening 11 composed of a diametrically-small hole portion 12 on the front side and a diametrically-large hole portion 13 on the backside. A glass 2 is fitted through a packing 81 in a diametrically-large annular groove portion 14 on the open end of the diametrically-small hole portion 12, and a case back 3 is screwed in the open end 15 of the diametrically-large hole portion 13. As a result, a chamber 4 is formed in the case 10 by the circumferential wall 16 of the case 10, the glass 2 and the case back 3.

A dial 20 made of a metallic disc is placed on a step portion 17 between the diametrically-small hole portion 12 and the diametrically-large hole portion 13, thereby to divide the chamber 4 into a chamber 5 on the front side and a chamber 6 on the back side. The dial 20 is provided with not only a center hole 21 but also an arcuate opening 22. The dial 20 has its surface 23 graduated for the time indication, and the opening 22 has a mark 24 on the peripheral edge of its central portion.

In the chamber 6, moreover, a main plate 25 made of a resin is arranged at a spacing in the thickness direction Z from the dial 20. The main plate 25 is provided with an arcuate opening 26 like that of the dial 20. However, this opening may be dispensed with, in case the main plate 25 is made of a resin. Between the dial 20 and the main plate 25, there are arranged a date indicator 27, which acts as a rotor capable for rotating on a center axis C, and a date indicator maintaining plate 28 for regulating the position of the date indicator 27 in the thickness direction. The date indicator 27 acting as time lapse indicating means or time information indicating means has a date indicator 29 circumferentially extending at a radial position to confront the opening 22 of the dial 20.

In the chamber 6 which is defined by the circumferential wall 16 of the case 10, the dial 20 and the case back 3, there are housed a button battery 7, a movement 30 and time data receiving/processing means 50. The electric/electronic parts composing the movement 30 and the time data receiving/processing means 50 are packaged in a printed circuit board 19. Of the electric/electronic parts, however, those of large weights and sizes are so supported as mounted or fixed in the main plate 25. Reference characters 7*f* and 7*g* designate plus and minus electrode terminals for the battery 7, and characters 19*f* designate a power supply terminal for the circuit block of the circuit board 19.

The movement 30 includes a crystal oscillator 31, a motor 32, a train wheel 33 and a watch driving IC 34 as shown in FIG. 3. The motor 32 is driven under the control of the crystal oscillator 31 and the IC 34 by the battery 7 thereby to drive the train wheel 33 rotationally. The train wheel 33 is coupled to the individual ends of a plurality of rotating axles 41 extending along the center axis C on the common axis, and time indicating hands such as an hour hand 42 and a minute hand 43 are attached to the individual other ends of the rotating axles 41. Here, the date indicator 27 is connected through the (not-shown) date indicator driving wheel to the train wheel 33.

The time data receiving/processing means 50 includes a receiving antenna 51 for receiving the standard radio waves containing the time data, and a receiving IC 52 for extracting the time data from the radio waves received from that antenna 51. As seen from FIG. 2 and FIG. 3, the receiving antenna 51 is fixed on the main plate 25 at a position to just confront the opening 22 of the dial 20, and includes an arcuate magnetic core 53, and a coil 54 wound on the core 53. Typically, the receiving antenna 51 entirely confronts the inside of the opening 22 of the dial 20, as shown in FIG. 2.

In the radio-wave watch 1 thus configured, the receiving antenna 51 is so exposed that its entirety including receiving end portions 55 and 56 is seen, if the date indicator 27 is absent, through the opening 22 of the dial 20. In this radio-wave watch 1, moreover, the date indicator 27 is made of a resin and does not obstructs the transmission of radio waves practically, so that the standard radio waves containing the time data can be reliably received by the receiving antenna 51 through the resin date indicator 27 and the opening 22 of the metallic dial 20.

In this radio-wave watch 1, moreover, the receiving antenna 51 at the back of the opening 22 of the dial 20 is hidden from the view field of the user by the date indicator 27, and the opening 22 of the dial 20 alternatively forms the display area for indicating the date with the date indicator 27. In the surface 23 of the dial 20, the portion near the peripheral edge portion of the opening 22 is given the mark 24 in an arrow shape so that the date corresponding to the rotational position of the date indicator 27 is indicated by the mark 24.

In this radio-wave watch 1, therefore, the opening 22 of the metallic dial 20 acts not only as the transmission passage of the radio waves to the receiving antenna 51 positioned on the back but also as the display aperture for the date indication by the date indicator 27 positioned between the receiving antenna 51 and the dial 20. The resin date indicator 27 gives the date indication in the opening 22 while hiding the receiving antenna 51 from the view field of the user.

In this radio-wave watch 1, the dial 20 is made of a metal so that it has an excellent appearance.

Here, the time information indicating means, as arranged between the dial 20 and the receiving antenna 51, for giving the time information exemplified not only by the date indicator 27 for giving the date information but also by an hour indicator (or an hour disc) for giving the time information, or a minute indicator or a second indicator for giving the minute or second information. These indicators are made of an inconductive material such as a resin for allowing the transmission of radio waves, and are typically formed into a disc or annular shape so that they are rotated according to the rotations of the corresponding portion of the train wheel thereby to give the time information of the corresponding kind through the opening 22 of the metallic dial 20.

An example, in which the time information indicating means is composed of the hour indicator or the hour disc, is shown as a second embodiment in FIG. 4. In a radio-wave watch 1*a* of the second embodiment shown in FIG. 4, the same members, components and portions as those of the radio-wave watch 1 of the first embodiment are designated by the common reference numerals, and components, which are substantially similar but partially different, are designated by attaching a suffix a.

The radio-wave watch 1*a* is provided with an hour disc 60 made of a resin on the back of the metallic dial 20. The hour disc 60 is fitted on the trunk portion of the hour indicating shaft or the hour wheel of the hand mounting rotating axles 41. A main plate 25*a* is provided with an annular support leg portion 61, which is mounted on the outer circumference on the side confronting the dial 20 and protruded toward the dial 20. The support leg portion 61 may also be composed of a plurality of support protrusions formed at an interval in the circumferential direction. The hour disc 60 is loosely fitted in a circular recess 62, which is formed by the support leg portion 61 of the main plate 25 so that it is rotated like the hour indicator on the center axis as the hour wheel trunk portion rotates. The hour disc 60 has an hour indicator 63 along the circumferential direction at the radial position confronting the opening 22. In this radio-wave watch 1*a*, the indicator is composed of only the minute hand 43, for example. However, the indicator may be a second hand or, if desired, an hour hand for indicating the hour over the hour indicator.

Here, the hour disc 60 may be so connected to the hour wheel of the train wheel 33 through an intermediate wheel as to make one rotation for 24 hours as a 24-hour indicator. Moreover, the hour disc 60 need not be continuously rotated but may also be rotated intermittently every hours, for example.

In this radio-wave watch 1*a*, too, the dial 20 is made of a metal so that its good appearance can be easily maintained. Not only the opening 22 of the dial 20 and the resin hour disc 60 retain the reception of the radio waves by the receiving antenna 51, but also the hour indicator 63 of the hour disc 60 gives the hour indication in the opening 22 of the dial 20.

Here in the radio-wave watch 1*a* of FIG. 4, for example, the disc 60 need not be the hour disc making one rotation for 12 or 24 hours but may be either a minute disc making one rotation for 60 minutes or a second disc making one rotation for 60 seconds. Naturally, letters or marks for indicating minutes or seconds are attached, for the individual cases, along a circle of a radius to confront the opening 22 of the dial 20. In the case of the second disk making one rotation for 60 seconds, for example, the letters may be replaced as marks by various drawings or pictures. In this case, different pictures can be displayed every seconds.

The opening 22 of the dial 20 has been described hereinbefore as a mere arcuate hole. In any case, the opening 22 may be a member of an inconductive and transparent material such as the glass plate fitted as a window. In this case, the glass plate need not be homogeneously transparent in the entirety of the arcuate opening 22, but may be transparent at the present time position, as indicated by the arrow, in the dial 20, and either may have the lower transparency on the two sides as it goes the farther from the present time position or may be opaque everywhere other than the present time position. In case such glass plate is provided, the second indicator may have pictures taking slightly different pauses so that they may be viewed as a motion picture when continuously seen. Here, the disc 60 need not make one rotation for 60 seconds but may make one rotation for a shorter time such as several minutes. As the case may be, the time for one rotation may be made adjustable.

In the description thus far made, the opening 22 of the dial 20 has been described to have the arcuate shape because the receiving antenna 51 is arcuate. In case, however, the receiving antenna 51 has a straight rod shape, the opening 22 may also have a rectangular shape. Even if the receiving antenna 51 has a shape such as the straight rod shape other than the arcuate shape, the opening 22 may be formed into such an arcuate shape as to fit the indication of the day, date, hour, minute and second of the date indicator, the day indicator, the hour indicator, the minute indicator and the second indicator, so long as the opening 22 contains the receiving antenna 51 within its range.

In case, moreover, the opening 22 is arcuate, it need not have a substantially equal width all over its entirety but may also be wider at portions confronting the exposed end portions of the two sides of the coil of the core 53 and may have a relatively thin aperture between the two positions. In this case, wider open portions may also be formed at just the intermediate portion between the two portions thereby to indicate the day, date, hour, minute and second easily.

Here, the display plate for the time information need not be arranged between the dial 20 and the receiving antenna 51, but the receiving antenna 51 may also confront the opening 22 of the dial 20 directly. A radio-wave watch 1*b* of this case is shown in FIG. 5.

In this radio-wave watch 1*b* of the third embodiment, the same members, components and portions as those of the radio-wave watch 1 of the first embodiment are designated by the common reference numerals, and components, which are substantially similar but partially different, are designated by attaching a suffix b.

In the radio-wave watch 1*b* of the third embodiment, no clearance is made between a main plate 25*b* and the dial 20, and the main plate 25*b* is directly superposed on the dial 20. As a result, the receiving antenna 51 confronting the arcuate opening 26 of the main plate 25*b* also directly confronts the arcuate opening 22 of the dial 20. A case 10*b* has an accordingly small thickness in the direction Z.

This radio-wave watch 1*b* can function like the radio-wave watch 1 at the time of receiving the radio waves. In this radio-wave watch 1*b*, moreover, the receiving antenna 51 can be seen from the outside through the arcuate opening 22 of the dial 20 and the arcuate opening 26 of the main plate 25*b* thereby to satisfy the tastes of the user for the mechanics.

Here, what is arranged between the dial 20 and the receiving antenna 51 need not be a rotating member such as the disc but may be a stationary one. In a radio-wave watch 1*c* of the fourth embodiment, the same members, components and portions as those of the radio-wave watch 1 of the first embodiment are designated by the common reference numerals, and components, which are substantially similar but partially different, are designated by attaching a suffix c.

In the radio-wave watch 1*c* of the fourth embodiment, as shown in FIG. 6, a liquid-crystal display panel 70 is arranged between a dial 20*c* and the receiving antenna 51. In this example, the liquid-crystal display panel 70 has a rectangular contour in its entirety, and its display area 71 is also rectangular. The display area 71 includes an hour indication area 72, a minute indication area 73, and a delimiter area 74 of the mode ":" positioned between the two areas 72 and 73.

In the radio-wave watch 1*c*, more specifically, a main plate 25*c* is provided with a recess 76 of such a rectangular shape as is substantially complementary to the contour of the liquid-crystal display panel 70. In this example, the liquid-crystal display panel 70 has its back substantially flush with the back of the main plate 25*c* so that the receiving antenna 51 is placed/fixed on the back of the liquid-crystal display panel 70. In the bottom wall 77 of the recess 76, there is formed an opening 26*c*, which is slightly larger than the display area 71 of the liquid-crystal display panel 70. The opening 26*c* may be coextensive with the display area 71 of the liquid-crystal display panel 70. The main plate 25*c* can be provided with a plurality of leg portions 78 at desired portions so that it may best ably placed on the dial 20*c*. The leg portions 78 may be expanded in a plate shape toward the front face.

In the radio-wave watch 1*c*, the dial 20*c* has an opening 22*c* formed into not an arcuate shape but a rectangular shape. This opening 22*c* has a size and a shape identical to those of the display area 71 of the liquid-crystal display panel 70, and the opening 22*c* of the dial 20*c* has a circumferential wall defining the outer edge of the display area 71 of the liquid-crystal display panel 70. Here, the rectangular opening 22*c* of the dial 20*c* is sized to fit the receiving antenna 51 snugly therein. The opening 22*c* is formed at such a position that the receiving antenna 51 can be viewed in its entirety, in the absence of the liquid-crystal display panel 70, through the opening 22*c* from the surface side of the dial 20. Therefore, naturally, the opening 26*c* and the recess 76 of the main plate 25*c* are opened over a wider range than that of the receiving antenna 51. Here, the receiving antenna 51 need not be arcuate but may have another shape such as a straight shape so long as it raises no obstruction in the chamber 6.

In this radio-wave watch 1*c*, too, the liquid-crystal display panel 70 includes the conductive portion slightly so that it can be made, roughly speaking, of an inconductive high polymer material such as a resin. Therefore, the receiving antenna 51 can receive surely the radio waves through the opening 22*c* of the dial 20*c* and the portion of the liquid-crystal display panel 70 so that it can act in high sensitivity. Moreover, the opening 22*c* of the dial 20*c* can be used for the time indication with the display area 71 of the liquid-crystal display panel 70 so that the user can enjoy the time indication by the liquid-crystal display panel 70, together with the excellent appearance of the metallic dial 20*c*.

In the shown example's, the opening 22 is located at the position of six o'clock but may be located at another position such as the position of three, nine or twelve o'clock.

What is claimed is:

1. A radio-wave watch comprising:

a metallic dial having an opening; and a receiving antenna for receiving the standard radio waves containing time data;

wherein the receiving antenna is arranged on the back of the opening of the dial and in a case at a position to confront the opening.

2. A radio-wave watch according to claim 1, wherein the receiving antenna is arranged in the case at a spacing from the dial on the back of the opening of the dial and at the position to confront the opening, and further comprising time lapse indicating means arranged in the case between the dial and the receiving antenna for indicating time lapse within the range of the opening.

3. A radio-wave watch according to claim 2, wherein the time lapse indicating means includes time information indicating means for indicating at least one of the day, date, hour, minute and second.

4. A radio-wave watch according to claim 3, wherein the receiving antenna extends in an arcuate shape near the inner circumference of the case, and wherein the time information indicating means is made of a rotating member.

5. A radio-wave watch according to claim 2, wherein the time lapse indicating means is made of a liquid-crystal panel.

* * * * *